US009863373B2

(12) United States Patent
Woods et al.

(10) Patent No.: US 9,863,373 B2
(45) Date of Patent: Jan. 9, 2018

(54) PASSIVE BYPASS VALVE FOR AN ACTIVE PURGE PUMP SYSTEM MODULE

(71) Applicant: Continental Automotive Systems, Inc., Auburn Hills, MI (US)

(72) Inventors: Brian Gordon Woods, Chatham (CA); Thierry Collet, Fontenilles (FR)

(73) Assignee: Continental Automotive Systems, Inc., Auburn Hills, MI (US)

( * ) Notice: Subject to any disclaimer, the term of this patent is extended or adjusted under 35 U.S.C. 154(b) by 172 days.

(21) Appl. No.: 14/568,978

(22) Filed: Dec. 12, 2014

(65) Prior Publication Data

US 2015/0211449 A1 Jul. 30, 2015

Related U.S. Application Data

(60) Provisional application No. 61/933,416, filed on Jan. 30, 2014.

(51) Int. Cl.
*F02M 25/08* (2006.01)

(52) U.S. Cl.
CPC ..... *F02M 25/0836* (2013.01); *F02M 25/089* (2013.01); *F02M 25/0818* (2013.01)

(58) Field of Classification Search
CPC ..... F02M 25/0836; F02M 25/0818; F02M 25/089; F02M 35/0218; F02M 35/042; F02M 33/00; F02M 33/02; F02M 33/04; F02M 33/08
USPC ..... 123/518, 519, 520, 521
See application file for complete search history.

(56) References Cited

U.S. PATENT DOCUMENTS 5,767,395 A * 6/1998 Goto ..... F02M 25/0809 123/520
6,460,517 B1 10/2002 Dauer
6,834,535 B2 * 12/2004 Kano ..... F02M 25/0818 73/114.38
7,267,113 B2 * 9/2007 Tsuge ..... F02M 25/0836 123/520
7,296,600 B2 * 11/2007 Ferreria ..... F02M 25/0836 141/302
7,497,209 B2 * 3/2009 Annoura ..... F02M 25/089 123/520
7,568,472 B2 * 8/2009 Woody ..... F02M 5/14 123/437
7,591,251 B1 * 9/2009 Roche ..... F02M 37/20 123/516

(Continued)

FOREIGN PATENT DOCUMENTS

CN 102400820 A 4/2012
DE 102005003629 A1 7/2006

(Continued)

*Primary Examiner* — Grant Moubry

(57) ABSTRACT

An active purge system module which includes a passive bypass valve assembly that allows for purge of a canister with engine vacuum or through the use of a pump, and also provides the functions of allowing air to escape the fuel tank during refueling. The valve assembly includes two valve members, which are moved between open and closed positions to direct air through the valve assembly during periods of engine vacuum, or when the valve assembly receives positive pressure from a pressure pump. The module is also used to perform a leak check when the valves are both in a closed position.

10 Claims, 2 Drawing Sheets

(56) References Cited

U.S. PATENT DOCUMENTS

| | | | | |
|---|---|---|---|---|
| 8,342,157 | B2 * | 1/2013 | Der Manuelian .. | F02M 25/0809 123/495 |
| 2004/0173190 | A1 * | 9/2004 | Makino ..... | F02D 41/004 123/520 |
| 2008/0053413 | A1 * | 3/2008 | Donahue ..... | A01D 34/82 123/510 |
| 2012/0152210 | A1 | 6/2012 | Reddy et al. | |
| 2014/0013944 | A1 | 1/2014 | Haag et al. | |

FOREIGN PATENT DOCUMENTS

| | | | |
|---|---|---|---|
| DE | 102010064240 | A1 | 6/2012 |
| EP | 1221547 | A2 | 7/2002 |
| EP | 2619435 | A1 | 7/2013 |

* cited by examiner

PASSIVE BYPASS VALVE FOR AN ACTIVE PURGE PUMP SYSTEM MODULE

CROSS-REFERENCE TO RELATED APPLICATIONS

This application claims priority to U.S. Provisional Patent Application No. 61/933,416, filed Jan. 30, 2014.

FIELD OF THE INVENTION

The invention relates generally to a passive bypass valve for an active system purge module.

BACKGROUND OF THE INVENTION

Carbon canisters are commonly used to store purge vapor from a fuel tank until the purge vapor can be disposed of. Most vehicles have an airflow system which is used to remove purge vapor from the canister, and transfer the purge vapor to the engine, where the purge vapor is burned off during combustion. Some types of purge systems use manifold vacuum to draw air through the canisters and pull the vapors into the engine. However, systems which use manifold vacuum may not always generate enough vacuum to draw sufficient amounts of air through the canister to pull the purge vapor into the engine. With turbocharged engines, the manifold pressure is used with a venturi-style of nozzle to create a vacuum for purging. The drawback to this approach is that directing pressurized air away from the turbocharger reduces the efficiency of the turbocharger, and reduces the amount of power increase to the engine.

Accordingly, there exists a need for an air flow system of an engine which provides for sufficient transfer of purge vapor to the engine, without sacrificing engine efficiency.

SUMMARY OF THE INVENTION

The present invention is an active purge system module which includes a passive bypass valve assembly that allows for purge of a canister with engine vacuum or through the use of a pump, and also provides the functions of allowing air to escape the fuel tank during refueling. The valve assembly includes two valve members, which are moved between open and closed positions to direct air through the valve assembly during periods of engine vacuum, or when the valve assembly receives positive pressure from a pressure pump. The module is also used to perform a leak check when the valves are both in a closed position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
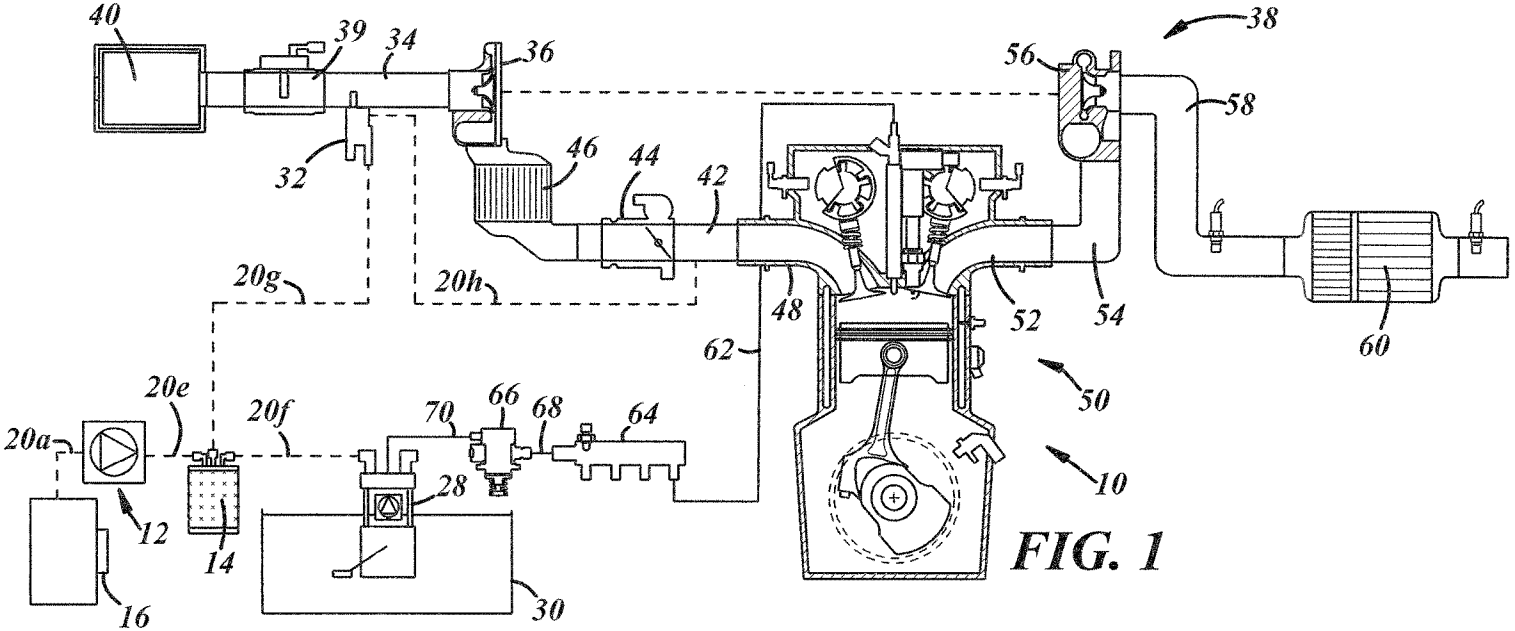
FIG. 1 is a diagram of an airflow system for a vehicle having an active purge system module which includes a passive bypass valve assembly, according to embodiments of the present invention.

The following description of the preferred embodiment(s) is merely exemplary in nature and is in no way intended to limit the invention, its application, or uses.

A diagram of an airflow system of a vehicle having an active purge system according to the present invention is shown generally at 10. The system 10 includes an active purge system module, shown generally at 12, which is in fluid communication with a carbon canister 14. The module 12 is in fluid communication with an air filter 16 through the use of a first conduit 20*a*, which intakes air from the atmosphere. More specifically, the first conduit 20*a* is connected to and in fluid communication with a second conduit 20*b* and a third conduit 20*c*. The second conduit 20*b* is in fluid communication with an electrical pump 18 that provides a source of pressurized air. The second conduit is also in fluid connection with the third conduit 20*cv*. A pressure bypass valve assembly 22 is in fluid communication with the electrical pump 18 through the use of a fourth conduit 20*d*. Also connected to the valve assembly 22 is a fifth conduit 20*e*, and located in the fifth conduit 20*e* is a pressure sensor 24. The fifth conduit 20*e* is connected to an in fluid communication with the carbon canister 14. The pump 18 and the pressure sensor 24 are in electrical communication with a pump controller 26.

The canister 14 is also in fluid communication with a fuel module 28 through the use of a sixth conduit 20*f*, and the fuel module 28 is disposed in a fuel tank 30. Also connected to the canister 14 and a turbo purge valve (TPV) 32 is a seventh conduit 20*g*, which places the canister 14 in fluid communication with the TPV 32. The TPV 32 is connected to an intake conduit 34. Conduit 34 is also the intake of the supercharger. In the example shown, the conduit 34 is connected to a turbocharger compressor 36, which is part of the turbocharger unit, shown generally at 38. Disposed in the intake conduit 34 is a mass air-flow sensor 39, and connected to the intake conduit 34 is an air filter 40.

Also connected to the TPV 32 is an eighth conduit 20*h*, which places the TPV 32 in fluid communication with a second intake conduit 42. Also disposed in the second intake conduit 42 is a throttle 44 and connected to the second intake conduit 42 and the compressor 36 is an intercooler 46. The second intake conduit 42 is connected to an in fluid communication with the intake manifold 48 of a reciprocating piston internal combustion engine, shown generally at 50.

The engine 50 also includes an exhaust manifold 52 connected to a first exhaust conduit 54, and the first exhaust conduit 54 is connected to a turbine 56, which is also part of the turbocharger unit 38. Exhaust gas passes through the turbine 56, through a second exhaust conduit 58 and through a muffler 60.

The engine 50 receives fuel from a fuel conduit 62, and the fuel conduit 62 is connected to an in fluid communication with a fuel rail 64. The fuel rail 64 is in fluid communication with a fuel distribution valve 66 through the use of a second fuel conduit 68. The fuel distribution valve 66 is also in fluid communication with the fuel module 28 through the use of a third fuel conduit 70.

Figure 2:
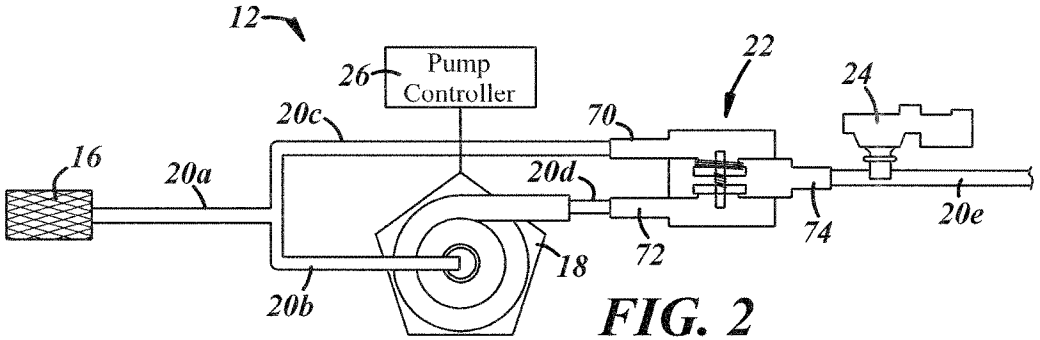
FIG. 2 is a diagram of an active purge system module having a passive bypass valve assembly, according to embodiments of the present invention.
Figure 3A:
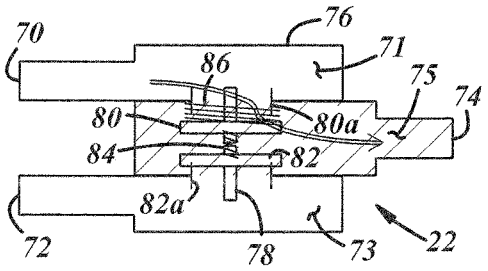
FIG. 3A is a diagram of a passive bypass valve assembly in a first mode of operation, according to embodiments of the present invention.
Figure 3B:
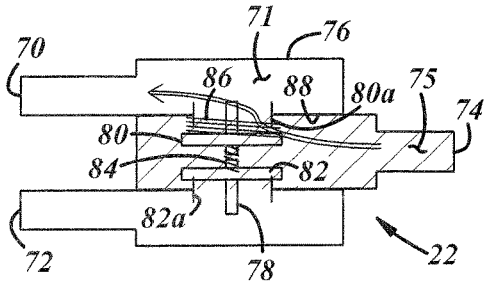
FIG. 3B is a diagram of a passive bypass valve assembly in a second mode of operation, according to embodiments of the present invention.
Figure 3C:
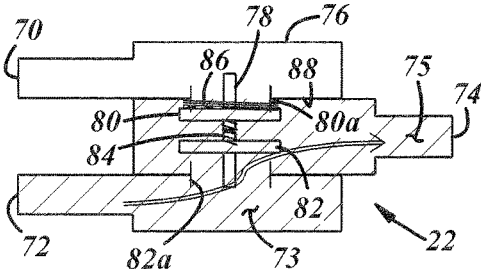
FIG. 3C is a diagram of a passive bypass valve assembly in a third mode of operation, according to embodiments of the present invention.
Figure 3D:
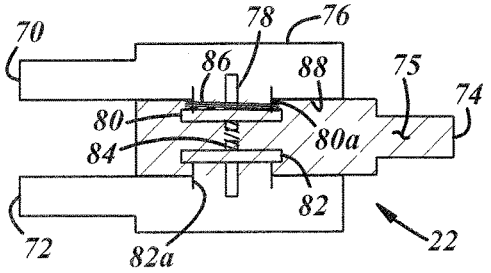
FIG. 3D is a diagram of a passive bypass valve assembly in a fourth mode of operation, according to embodiments of the present invention.

With reference now to FIGS. 2-3D, the passive bypass valve assembly 22 includes a first port 70. The first port 70 is connected with a first chamber 71 of the bypass valve assembly. The first port 70 is connected to the third conduit 20*c*. A second port 72 is connected to a second chamber 73 of the bypass valve assembly. The second port 72 is also connected to the fourth conduit 20*d*. A third port 74 is connected a third chamber 75 of the bypass valve assembly. The third port 74 is also to the fifth conduit 20*e*. The ports 70, 72, 74 are all connected to a housing 76, and disposed in the housing 76 is a guide member 78. A first valve member 80 and a second valve member 82 are mounted to the guide member 78 within the third chamber 75 such that the valve members 80, 82 are able to slide relative to one another, and relative to the guide member 78. The first valve member 80 controls flow between the first and third chambers 71, 75. The second valve member 82 controls flow between third and second chambers 75, 73. The first valve member 80 is selectively in contact with a first valve seat 80*a*, and the second valve member 82 is selectively in contact with a second valve seat 80*b*.

The guide member 78 in this embodiment is a cylindrical post, but it is within the scope of the invention that the guide member 78 may be other shapes as well. A first spring member 84 is mounted to the guide member 78 in between the valve members 80, 82, such that the first spring member 84 biases the valve members 80, 82 away from one another. As shown, the final spring member 84 is a coil spring, but other spring designs may be utilized. A second spring member 86 surrounds the guide member 78, and is disposed between the first valve member 80 and an inner wall 88 of the housing 76. The second spring member 86 has a larger diameter than the first spring member 84. The second spring member 86 also surrounds the first valve seat 80*a*, such that the second spring member 86 biases the first valve member 80 away from the first valve seat 80*a*. As shown, the second spring member 86 is a coil spring, but other spring designs may be utilized.

The spring members 84, 86 are configured to apply force to the valve members 80, 82 to facilitate different modes of operation. During a first mode of operation, shown in FIG. 3A, the engine 50 is creating vacuum, and the turbocharger unit 38 is not active; therefore, the engine 50 is naturally aspirated. The bypass valve assembly 22 is exposed to the engine vacuum via the canister 14. The spring members 84, 86 are configured such that the first valve member 80 is not in contact with the first valve seat 80*a*, and is therefore in an open position, and the second valve member 82 is in a closed position. When the valve members 80, 82 are in the configuration shown in FIG. 3A, the vacuum draws from the first conduit 20*a*, through the third conduit 20*c*, passively through the valve assembly 22 and the fifth conduit 20*e*. The air then flows through the canister 14, drawing purge vapor from the canister 14 through the seventh conduit 20*g*, through the TPV 32, the eighth conduit 20*h*, and into the second intake conduit 42.

During a second mode of operation, the valve assembly 22 is exposed to air venting from the fuel tank 30. The valve assembly 22 is configured as shown in FIG. 3B, which is substantially similar to the configuration shown in FIG. 3A, where the first valve member 80 is in the open position, but air is flowing from the fifth conduit 20*e* into the valve assembly 22, through the valve assembly 22 and out of the first port 70 into the third conduit 20*c*. The valve assembly 22 is configured as shown in FIG. 3B during refueling of the fuel tank 30 passively allowing air to escape so pressure does not build in the fuel tank 30, while the fuel vapors are retained by the carbon canister 14.

During a third mode of operation, the valve assembly 22 is configured as shown in FIG. 3C, and the pump 18 is activated, generating pressurized air that flows through the fourth conduit 20*d* and into the second port 72, the pressurized air applies enough force to the second valve member 82 to overcome the force from each of the spring members 84,86, and lift the second valve member 82 off of the valve seat 82*a*, and place the first valve member 80 in contact with the valve seat 80*a*. The pressurized air then flows out of the third port 74 and into the fifth conduit 20*e*, where the air then flows through the canister 14, drawing purge vapor from the canister 14 through the seventh conduit 20*g*, through the TPV 32, the eighth conduit 20*h*, and passively into the second intake conduit 42.

During a fourth mode of operation, a leak check is performed using the valve assembly 22. The TPV 32 is moved to a closed position, and pressurized air is generated by the pump 18, placing the valve members 80,82 in the position as shown in FIG. 3C. As pressure builds in the valve assembly 22, and the TPV 32 is in the closed position, eventually, there is no air pressure movement across the second valve member 82 and therefore no change in pressure across the second valve member 82. When this occurs, the first valve member 80 remains in contact with the first valve seat 80*a*, and the force from the spring member 84 places the second valve member 82 in contact with the second valve seat 82*a*, such that both of the valve members 80,82 are in closed positions, as shown in FIG. 3D. The pressure in the area of the housing 76 between the valve members 80, 82 is the same as what is in the fifth conduit 20*e*, and this pressure is detected by the sensor 24. As long as the valve members 80, 82 are in their respective closed position, the pressure remains constant. If the pressure declines, the pressure change is detected by the sensor 24, therefore providing an indication that a leak is in the system 10 in the canister or the components connected with the canister.

The TPV 32 has two check valve functions directing flow to either the first intake conduit 34 or to the second intake conduit 42. If vacuum is not present in the second intake conduit 42, the TPV valve delivers all of the vapor that is allowed to pass through it to the first intake conduit 34. TPV 32 delivers canister vapor to intake conduit 34 upstream of the turbocharger compressor 36 when the engine is being aspirated by the turbocharger 38. If vacuum is present in the second intake conduit 42, the TPV valve delivers all of the vapor that is allowed to pass through it to the second intake conduit 42. TPV 32 delivers canister vapor to second intake conduit 42 downstream of the turbocharger compressor 36 when the engine is being naturally aspirated. Additionally, TPV 32 is duty cycled controlled to prevent delivering to the engine an excessive amount of vapor through either the first conduit 34 or to the second conduit 42.

To customize the use of the invention based upon a given engine application, certain modifications can be made. The operation of the pump 18 can commence upon the engine reaching a predetermine speed. The required active pumping of air through the canister can be a function of the pressure drop across the air filter 40 connected with the intake conduit 34. Accordingly the cleaner the air filter 40 is, the more likely the pump 18 will be operated. Typically the pump controller 26 is operatively associated with a pulse width modulated controlled motor.

Figure 4:
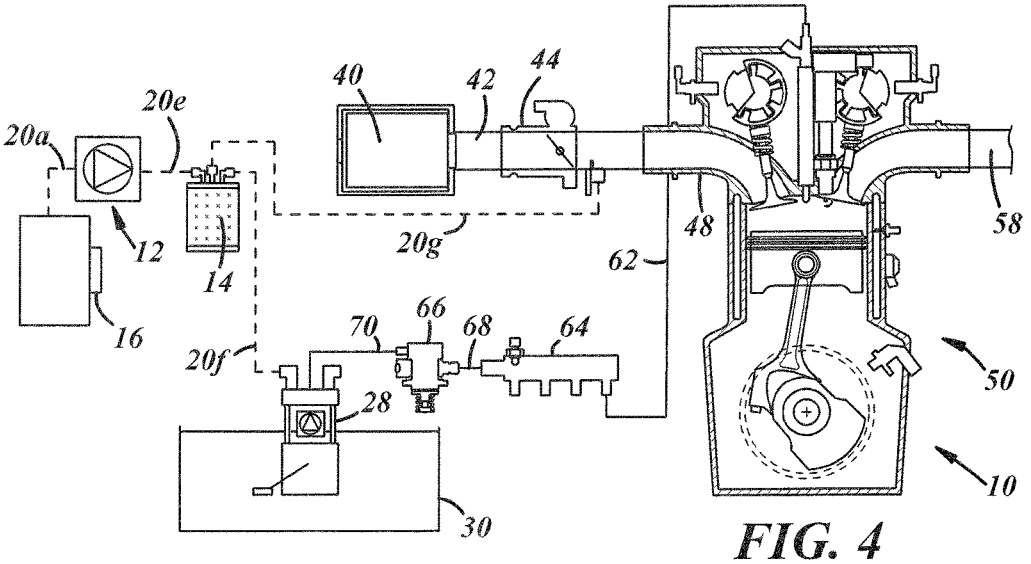
FIG. 4 is a diagram of an alternate embodiment of an airflow system for a vehicle having an active purge system module which includes a passive bypass valve assembly, according to embodiments of the present invention.

An alternate embodiment of the present invention is shown in FIG. 4, with like numbers referring to like elements. In this embodiment, the engine 50 is naturally aspirated, and there is no turbocharger unit 38 or intercooler 46. However, the operation of the valve assembly 22 is substantially similar to the embodiment shown in the previous Figures.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a purge system module, including:

a pump;

a valve assembly in fluid communication with the pump and a vapor canister;

a housing, the housing being part of the valve assembly;

a first valve member disposed in the housing, the first valve member being part of the valve assembly;

a second valve member disposed in the housing, the second valve member being part of the valve assembly; and a guide member, the first valve member and the second valve member connected to the guide member such that the first valve member and the second valve member are able to move relative to one another, the first valve member is able to move relative to the guide member, and the second valve is able to move relative to the guide member;

wherein the valve assembly is configurable such that pressurized air from the pump is transferred through the valve assembly, removing purge vapor from the vapor canister, and transferring the purge vapor from the vapor canister to an engine, and the valve assembly is also configurable such that vacuum from the engine draws air through the valve assembly removing purge vapor from the vapor canister, and transferring the purge vapor to the engine.

2. The apparatus of claim 1, the valve assembly further comprising: wherein the valve assembly is placed in a first configuration such that the first valve member is in an open position and the second valve member is in a closed position, a second configuration where the first valve member is in a closed position and the second valve member is in an open position, and a third configuration where the first valve member and second valve member are in a closed position.

3. The apparatus of claim 2, further comprising:

a first spring member connected to the guide member, the first spring member biasing the first valve member away from the second valve member; and a second spring member connected to the guide member for biasing the first valve member toward the second valve member;

wherein the guide member guides the movement of the first valve member and the second valve member between the open and closed positions, as force is applied to the first valve member and the second valve member from the first spring member and the second spring member.

4. The apparatus of claim 3 wherein the guide member is a cylindrical post.

5. The apparatus of claim 3 wherein the first spring member is a coil spring.

6. The apparatus of claim 3 wherein said second spring member is a coil spring.

7. The apparatus of claim 6 wherein said first spring member is a coil spring and the second spring member has a larger diameter than the first spring member.

8. The apparatus of claim 3 wherein the housing has a first chamber for connection with the atmosphere, a second chamber for connection with the pump, a third chamber for connection with the canister, and wherein the first valve member is positioned within the third chamber for controlling flow between the third and first chamber, and the second valve member is within the third chamber for controlling flow between the second chamber and the third chamber.

9. The apparatus of claim 8 wherein a valve seat for the first valve member is within the third chamber.

10. The apparatus of claim 8 wherein a valve seat for the second valve member is within the third chamber.

* * * * *